United States Patent [19]

Bonenberger

[11] Patent Number: 4,710,131

[45] Date of Patent: Dec. 1, 1987

[54] LIMITED ROTATION TWIST CAPSULE

[75] Inventor: Kenneth E. Bonenberger, Blacksburg, Va.

[73] Assignee: Litton Systems, Inc., Blacksburg, Va.

[21] Appl. No.: 861,709

[22] Filed: May 12, 1986

[51] Int. Cl.[4] ..... H01R 39/02

[52] U.S. Cl. ..... 439/13; 174/117 F

[58] Field of Search ..... 339/2 L, 5 R, 5 M, 8 R; 174/117 F; 439/11, 13

[56] References Cited

U.S. PATENT DOCUMENTS 3,325,764 6/1967 Ward ..... 339/5 R
3,599,165 8/1971 Wendell et al. ..... 339/5

FOREIGN PATENT DOCUMENTS 220001 11/1957 Australia ..... 339/2 L
1111260 7/1961 Fed. Rep. of Germany ..... 339/2 L

*Primary Examiner*—Eugene F. Desmond
*Attorney, Agent, or Firm*—Brian L. Ribando

[57] ABSTRACT

A twist capsule includes a rotor and a stator which are rotatable relative to one another. Two portions of a flexible cable are fixed to the rotor and the stator with an intermediate cable portion therebetween. The intermediate cable portion is arranged in either a "Z" configuration or a helical wrap to prevent coiling and sliding of the cable on itself as the twist capsule rotates. The ends of the cable extend from the capsule for connection to external wiring.

3 Claims, 5 Drawing Figures

Fig_3A
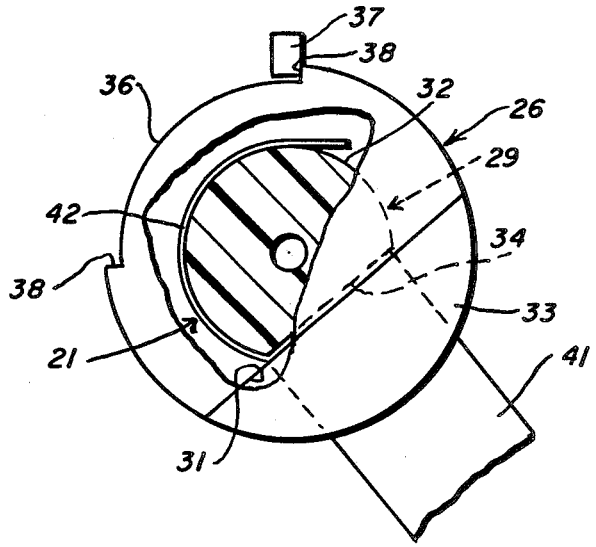
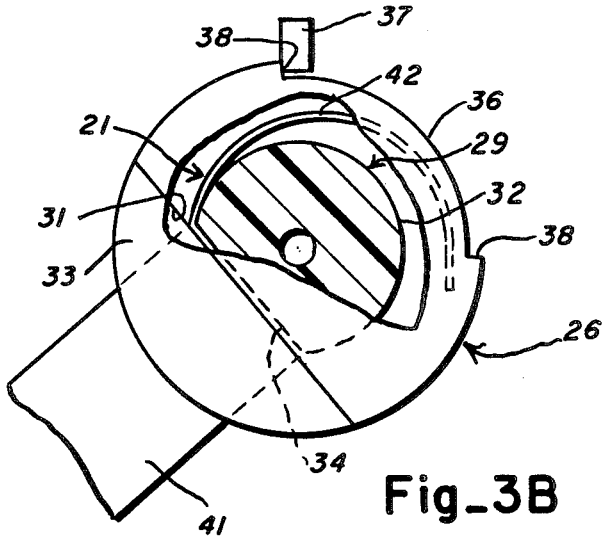
Fig_3B

LIMITED ROTATION TWIST CAPSULE

BACKGROUND OF THE INVENTION

This invention relates to a twist capsule which conducts signals on a continuous conductor between an input and an output which are rotatable relative to one another around the axis of the twist capsule.

Rotary joints for conducting signals between two points which are rotatable relative to one another are well known in the art. A slip ring is a type of rotary joint which is used when unlimited rotation is required. A slip ring comprises a sliding brush element which rides on the surface of a ring. Sliding contact slip rings are prone to wear due to the surface contact between the brush and the ring and are often a source of electrical noise which degrades the signal.

A twist capsule is another type of rotary joint which can be used if only limited rotation is required. U.S. Pat. No. 3,599,166 issued to Wendell et al shows a twist capsule in which a flat cable is wound in a spiral around the axis of the twist capsule. The inner and outer portions of the capsule are rotatable relative to one another in both clockwise and counterclockwise directions. Such rotation causes a coiling and uncoiling of the spirally wound flat cable around the capsule axis and around itself. Over a period of extended use, the coiling and sliding of the adjacent layers of cable on itself causes an abrasion of the cable insulation which can lead to capsule failure. Additionally, because one end of the flat cable is located in the center of the spiral, individual leads must be attached to that end of the flat cable in order to connect the cable to external wiring. The attachment of the leads to the flat cable is time consuming and adds undesirable cost and complexity to the capsule assembly.

It would be desirable to provide a limited rotation rotary joint which avoids the drawbacks of a spiral wrap device.

SUMMARY AND OBJECTS OF THE INVENTION

According to the invention, a limited rotation twist capsule comprises a rotor and a stator which are arranged along a common axis. A continuous length of flexible cable is fixed to both the rotor and the stator with the cable ends extending from the capsule for connection to external wiring. An intermediate portion of the cable extends between the rotor and stator and wraps around the capsule without coiling or tightening to prevent cable abrasion while allowing the required rotation.

It is accordingly an object of the invention to provide a twist capsule in which the cable ends extend from the capsule for connection to external wiring.

It is another object of the invention to provide a twist capsule in which the cable wraps around the capsule shaft without coiling or sliding against itself to prevent abrasion of the cable.

These and other objects of the invention will be apparent from the following detailed description in which reference numerals used throughout the description designate like or corresponding parts shown on the drawing figures.

BRIEF DESCRIPTION OF THE DRAWINGS

FIGS. 3A and 3B are top views of the twist capsule of FIGS. 1 and 2 showing the capsule in counterclockwise and clockwise stop positions.

DESCRIPTION OF THE PREFERRED EMBODIMENT

Figure 1:
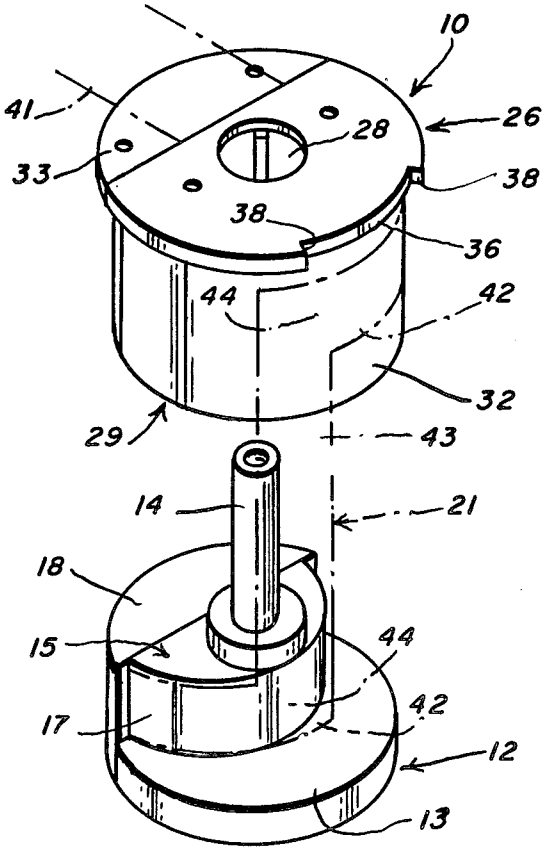
FIG. 1 is a perspective view of a twist capsule according to the invention.
Figure 2:
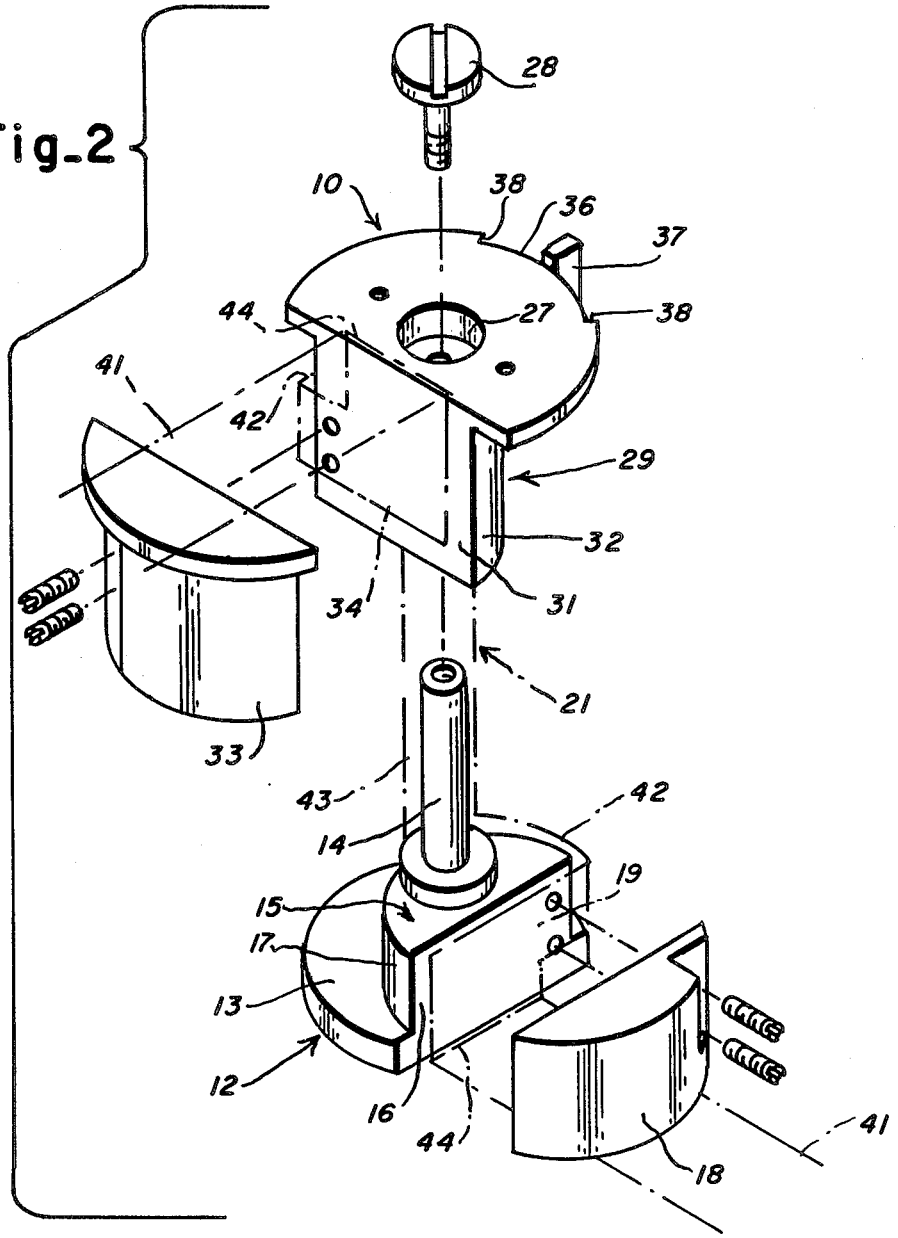
FIG. 2 is an exploded perspective view of the twist capsule of FIG. 1.

Turning now to the drawing figures there is shown in FIGS. 1 and 2 a twist capsule generally designated by the reference numeral 10. It will be noted that for clarity, the top and bottom elements of FIG. 2 are rotated relative to the corresponding elements of FIG. 1. The twist capsule 10 comprises a stator 12 having a base 13 and a shaft 14 which is perpendicular to the base. A stator boss 15 having a flat side 16 and a spool portion 17 opposite the flat side is mounted on the base 13. A stator clamp 18 mounts to the flat side 16 of the boss 15 by threaded fastening means and functions to capture a first portion 19 of a cable 21 between the flat side 16 and a stator clamp 18.

A rotor 26 includes a bore 27 by which the rotor 26 is mounted on the shaft 14, and a securing means 28 which engages the shaft 14 prevents inadvertent removal of the rotor 26 from the shaft. A rotor boss 29 having a flat side 31 and a spool side 32, similar to the stator boss 15, is mounted on the rotor. A rotor clamp 33 is fixed to the flat side 31 of the rotor boss 29 by threaded fastening means, and the rotor clamp 33 functions to capture a second portion 34 of the flexible cable 21 between the rotor boss 29 and the rotor clamp 33. The rotor 26 includes a cutout 36 formed around a portion of the periphery thereof, and a tooth 37 formed on an adjacent stationary structure (not shown) engages the cutout 36. The tooth 37 limits the clockwise and counterclockwise rotation of the rotor 26 by blocking against the end stops 38 of the cutout 36.

The flexible cable 21 which is used in the twist capsule 10 may comprise flexible printed circuit tape formed with a plurality of side by side parallel circuit paths. The flexible cable 21 includes two end portions 41 which extend from the rotor 26 and the stator 12 for connection to external wiring. Adjacent to the end portions 41 are the first and second portions 19 and 34 which are captured by the stator clamp 18 and the rotor clamp 33 respectively. The cable between the first and second portions 19 and 34 is generally "Z" shaped and comprises two wrap portions 42 which connect to the first and second portions 19 and 34, and a bridging portion 43 which connects the two wrap portions 42. Right angle bends 44 may be formed in the tape 21 between the end portions 41 and the first and second portions 19 and 34 to facilitate the extension of the flexible cable 21 away from the twist capsule 10.

As shown in FIG. 3A, rotation of the rotor 26 relative to the stator 12 in one direction causes the wrap portion 42 of the flexible cable to tighten around spool portion 32 of the rotor boss 29, and a similar tightening of the cable occurs around the stator boss 15. FIG. 3B shows that rotation of the rotor 26 in the opposite direction causes the wrap portion 42 to loosen. Rotation of the rotor 26 in either direction is limited by the blocking action of the tooth 37 against the end stops 38 of the cutout 36. The length of the two wrap portions 42 of the flexible cable is less than the circumferential distance around the spool portions 17 and 32 of the stator boss 15 and the rotor boss 29. This insures that the flexible cable 21 will not coil or slide against itself in a spiral as the rotor rotates relative to the stator.

DESCRIPTION OF AN ALTERNATE EMBODIMENT

Figure 4:
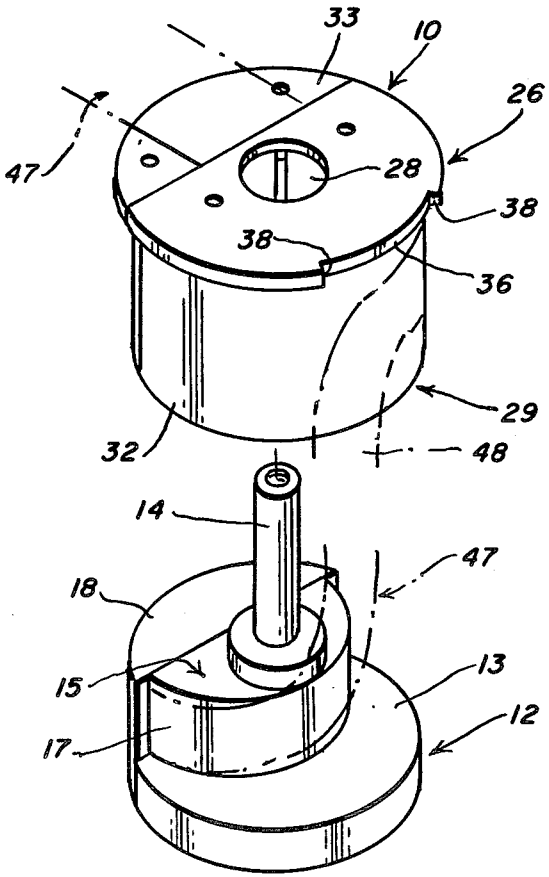
FIG. 4 is a perspective view of an alternate embodiment of a twist capsule.

FIG. 4 shows an alternate embodiment of the invention in which the flexible cable 47 is formed in a helix around the axis of the twist capsule 10. The helical wrap portion 48 of the cable wraps partially on the spool portion 32 on the rotor 26 and partially on the spool portion 17 on the stator 12. The length of the helical wrap portion 48 is selected so that the cable will not wrap onto itself as the rotor rotates relative to the stator. A stationary tooth (not shown) may be provided to limit the rotation of the rotor 26 to 45° in either direction by engaging the end stops 38 of the cutout 36 formed in the rotor 26.

Although the invention as shown and described utilizes a single flexible cable, plural layers of cable may be used in order to provide a greater number of circuits through the twist capsule. If more than one layer of cable is used, the wrap portions of the outer cables are made progressively longer than the wrap portions of the inner cables so that the wrap portions will not slide and abrade against one another during operation of the twist capsule.

Having thus described the invention, various alterations and modifications thereof will be apparent to those skilled in the art, which modifications and alterations are intended to be within the scope of the invention as defined by the appended claims.

What is claimed is:

1. A limited rotation twist capsule having an axis of rotation comprising:

a stator having a shaft extending therefrom which defines the axis of rotation of the twist capsule;

a rotor mounted on said shaft and rotatable relative to the stator;

a continuous flexible cable having end portions extending from the stator and the rotor;

first means for clamping a first portion of the continuous cable to the stator;

second means for clamping a second portion of the continuous cable to the rotor;

an intermediate portion of the continuous cable located between said first portion and said second portion; and two right angles in the intermediate portion of the continuous cable dividing the intermediate portion into three segments, whereby two of the segments are perpendicular to the axis of the twist capsule and one segment is parallel to the axis of the twist capsule, said intermediate portion having a "Z" shape and a length which is greater than the distance between the first means and the second means whereby the rotor is free to rotate a preselcted number of degrees relative to the stator.

2. The twist capsule of claim 1 further comprising:

a stator boss;

a stator clamp and fastening means comprising the first means for clamping, whereby the first portion of the continuous cable is captured between the stator boss and the stator clamp;

a rotor boss; and a rotor clamp and fastening means comprising the second means for clamping; whereby the second portion of the continuous cable is captured between the rotor boss and the rotor clamp.

3. The twist capsule of claim 2 further comprising:

a spool portion formed on the stator boss; and a spool portion formed on the rotor boss; wherein the length of each cable segment which is perpendicular to the axis of the twist capsule is less than the circumference of either spool portion.

* * * * *